United States Patent [19]

Zaubzer

[11] 3,999,320

[45] Dec. 28, 1976

[54] STARTER GUN

[75] Inventor: Ludwig E. Zaubzer, Monroe, N.Y.

[73] Assignee: Precise Imports Corporation, Suffern, N.Y.

[22] Filed: Apr. 9, 1975

[21] Appl. No.: 566,235

[52] U.S. Cl. ..... 42/58; 42/1 G; 42/54

[51] Int. Cl.[2] ..... F41C 3/02

[58] Field of Search ..... 42/1 G, 1 R, 54, 58, 42/59, 76 R

[56] References Cited

UNITED STATES PATENTS

| | | | |
|---|---|---|---|
| 1,775,178 | 9/1930 | VonFrantzius | 42/1 G |
| 2,042,934 | 6/1936 | Gill | 42/1 G |
| 3,354,571 | 11/1967 | Parker | 42/1 R |
| 3,775,888 | 12/1973 | Rohm | 42/58 |

*Primary Examiner*—Charles T. Jordan
*Attorney, Agent, or Firm*—Wegner, Stellman, McCord, Wiles & Wood

[57] ABSTRACT

A starter gun adapted for selectively firing blank cartridges and providing effective tear gas dissemination capability. The starter gun may comprise a pistol or revolver, and includes structure in the firing chamber and barrel thereof preventing use with conventional projectile ammunition.

14 Claims, 5 Drawing Figures

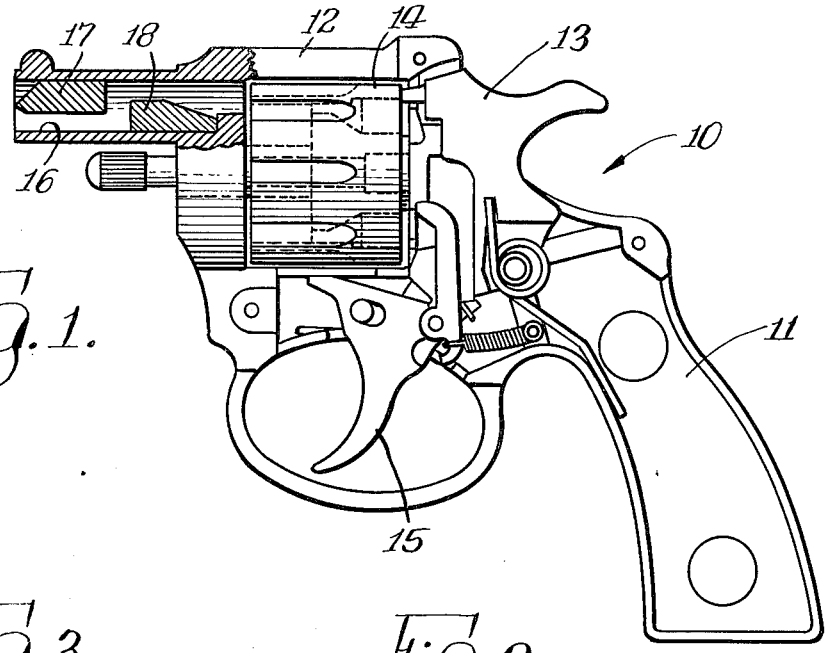
Fig. 1.
Fig. 3.
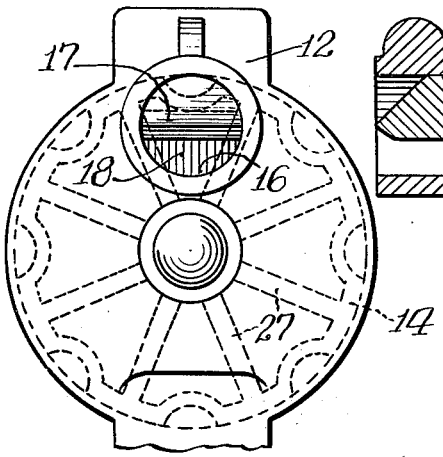
Fig. 2.
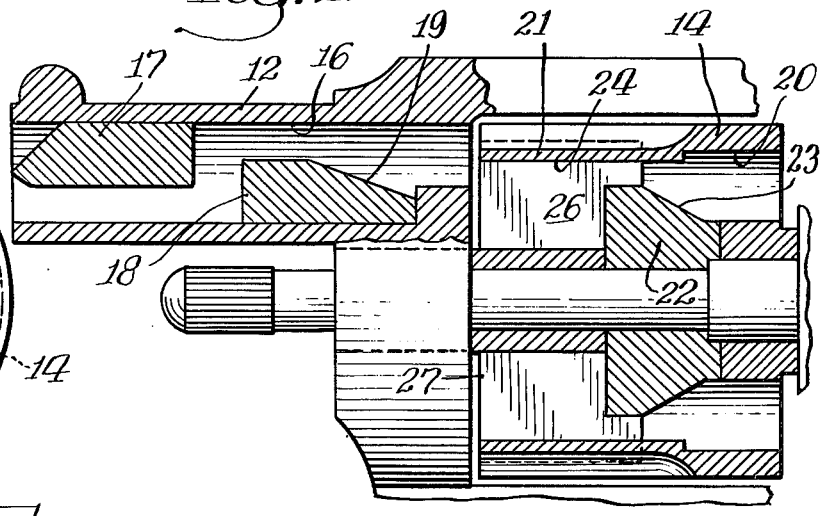
Fig. 4.
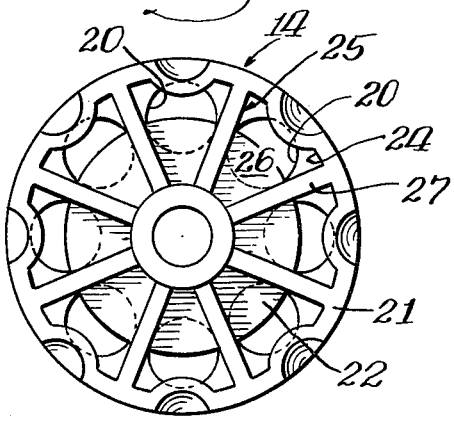
Fig. 5.
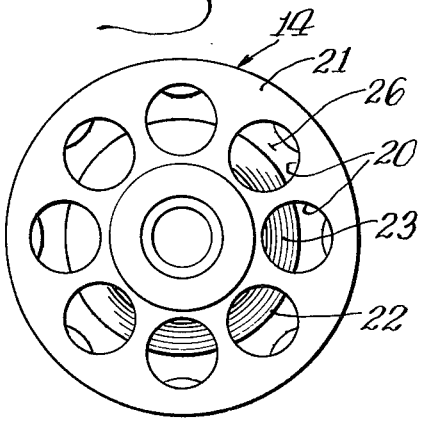

STARTER GUN

BACKGROUND OF THE INVENTION

1. Field of the Invention

This invention relates to starter guns adapted to prevent use of conventional ammunition therewith.

2. Description of the Prior Art

In conventional starter guns, the gun is arranged to fire only blank cartridges or blank ammunition. To prevent the use thereof with conventional ammunition wherein a projectile is discharged therefrom, the barrel has been provided with an obstruction extending the length thereof.

Further, in such starter guns, the firing chamber has included means for preventing insertion of conventional projectile-type cartridges including a rib preventing insertion of such cartridges fully into the firing chamber. The rib has been provided heretofore adjacent the rear of the firing chamber, and where the starter gun comprises a revolver, the firing chambers have opened into a relatively large cylindrical recess at the front of the cylinder. In the prior art structures, the starter gun is not effective for firing gas-emitting ammunition, such as tear gas cartridges, as the tear gas undergoes excessive dissipation before entering the barrel as a result of the back pressure caused by barrel obstructions.

SUMMARY OF THE INVENTION

The present invention comprehends an improved starter gun adapted for use not only as a starter gun for firing blank cartridges, but also as an effective tear gas emitting gun.

The illustrated embodiment utilizes the improved structure in a revolver wherein a cylinder is provided with a plurality of firing chambers opening into a forward emission space which is divided into portions corresponding to the respective firing chambers by an improved dividing wall means. This structure effectively maintains the concentration of tear gas emitted through the cylinder into the barrel so as to cause the starter gun to be an effective tear gas emitting gun.

Travel of a projectile through the barrel is effectively prevented by an improved barrel obstruction means which provides a nonrectilinear path for flow of gas through the barrel while preventing firing of a projectile directly therethrough.

Broadly, the invention comprehends providing a barrel having a nonrectilinear passage extending longitudinally through the barrel.

In the illustrated embodiment, the cylinder dividing wall means comprises a hardened steel insert defined by a plurality of radial walls and defining pie-shaped sectors of the cylinder corresponding one each with the respective firing chambers. The dividing wall means extends substantially to the front end of the cylinder whereby gas delivered to the chamber structure is directed into the barrel passage for improved delivery to the barrel for effective gas disseminating capability.

In the illustrated embodiment, the barrel obstruction means comprises hardened steel elements fixedly received in the through-bore of the barrel. Further more specifically, the obstruction elements may be provided at opposite ends of the barrel.

Thus, the present invention comprehends an improved starter gun which is extremely simple and economical of construction while yet providing the improved functioning and highly desirable advantages discussed above.

BRIEF DESCRIPTION OF THE DRAWING

Other features and advantages of the invention will be apparent from the following description taken in connection with the accompanying drawing wherein:

FIG. 1 is a side elevation of a starter gun embodying the invention with portions broken away to illustrate the internal construction thereof;

FIG. 2 is a fragmentary enlarged side elevation partially in section;

FIG. 3 is an end view looking to the right in FIG. 2;

FIG. 4 is an end view of the cylinder looking to the right in FIG. 2; and

FIG. 5 is an end view of the cylinder looking to the left in FIG. 2.

DESCRIPTION OF THE PREFERRED EMBODIMENT

In the exemplary embodiment of the invention as disclosed in the drawing, a starter gun generally designated 10 is shown to comprise an athletic starter revolver including a handgrip 11, a barrel 12, a hammer 13, a cylinder 14, and a trigger mechanism 15. Revolver 10 is generally similar to conventional athletic starter revolvers, but includes improved means for permitting the revolver to be used both as a starter gun for firing blank cartridges and a tear gas gun for effectively firing tear gas cartridges.

More specifically, the barrel 12 of revolver 10 is provided with means for positively preventing rectilinear discharge of a projectile through the barrel. More specifically, the barrel is provided with a through-bore 16 which effectively defines a serpentine passage which permits effective passage of tear gas outwardly therethrough while preventing straight through movement of a projectile. In the illustrated embodiment, the split passage is provided by means of a pair of obstructions 17 and 18 premanently fixed in the barrel bore 16. The obstructions may be formed of hardened steel and may be secured in the barrel by means such as welding. The obstructions may be mounted at longitudinally spaced positions in the barrel, and in the illustrated embodiment, are mounted in opposite ends of the bore 16. Obstruction 18 may be provided with an inclined surface 19 at its outer end for guiding the tear gas effectively through the serpentine passage.

As indicated briefly above, the invention further comprehends an improved construction of cylinder 14 wherein the cylinder is not only adapted for firing blank cartridges in a plurality of firing chambers 20 thereof, but is also adapted for effective transmission of tear gas into the barrel passage 16 for effective gas disseminating capability of the gun. The cylinder includes an outer tubular wall 21. The rear end of the cylinder is provided with a plurality of cylindrical firing chambers 20, as seen in FIGS. 2 and 5, for receiving selectively blank cartridges or tear gas cartridges, as desired. The cylinder includes a core 22 having a frustoconical rear surface 23 leading from the respective firing chambers into a forward annular space 24 at the front of the cylinder.

The present invention comprehends providing a dividing wall means generally designated 25 which, as shown in FIG. 4, divides the forward space 24 of cylinder 14 into a plurality of pie-shaped sectors generally designated 26 corresponding one each with the different firing chambers 20. Thus, the dividing wall means includes a plurality of radial walls 27 extending outwardly from the cylinder core 22, as best seen in FIG. 4, to define the respective gas transferring spaces 26 leading directly into the barrel passage 16, as seen in FIG. 2. The division of space 24 into the individual sectors 26 effectively concentrates the tear gas emission from the firing chamber 20 into the barrel passage 16 with minimum loss by dissipation through the space between the cylinder and barrel.

While the tear gas is thereby delivered with a relatively high force for effective gas dissemination capability, the barrel obstructions 17 and 18 prevent ejection of a projectile through the barrel without substantially affecting the desired tear gas dissemination.

In the illustrated embodiment, the cylinder dividing wall means 25 comprises a hardened steel insert providing facilitated installation.

Thus, the starter gun of the present invention is extremely simple and economical of construction while yet permitting the selective use thereof both as a starter gun and a gas disseminating gun. Improved barrel obstruction means are provided synergistically providing for improved gas flow while positively precluding projectile ejection.

The foregoing disclosure of specific embodiments is illustrative of the broad inventive concepts comprehended by the invention.

I claim:

1. A starter gun for selectively firing blank cartridges and tear gas, comprising:

a cylinder having a rear portion defining a plurality of firing chambers each adapted to receive selectively alternatively a blank cartridge and a tear gas cartridge, and a front portion defining a transfer passage for conducting tear gas forwardly from said firing chambers;

a barrel extending forwardly from said cylinder front portion and defining a through-bore;

means for firing cartridges in said firing chambers seriatim aligned with said barrel;

wall means dividing said transfer passage of the clyinder front portion into a plurality of through-passages aligned one each with said firing chambers for providing a concentrated emission of tear gas from a fired tear gas cartridge in the associated one of said firing chambers into said barrel through-bore; and blocking means in said barrel for partially transversely blocking said through-bore at a plurality of longitudinally spaced positions, said blocking means being positioned to effectively prevent any straight through-passage longitudinally through said through-bore while permitting effectively free tear gas discharge through said through-bore.

2. The starter gun of claim 1 wherein said wall means comprises a plurality of flat divider walls extending radially to the axis of said cylinder.

3. The starter gun of claim 1 wherein said blocking means and said barrel cooperatively define a serpentine passage through said barrel for freely passing tear gas outwardly therethrough while positively preventing a rectilinear discharge of a projectile therethrough.

4. The starter gun of claim 1 wherein said through passages of the cylinder have a larger cross-sectional area than the cross-sectional area of said barrel through-bore transversely of said blocking means.

5. A starter gun for selectively firing blank cartridges and tear gas cartridges, comprising:

means defining a firing chamber having a rear portion adapted to receive selectively alternatively a blank cartridge and a tear gas cartridge, and a front portion;

means for firing a cartridge in said chamber; and a barrel extending forwardly from said front portion of the firing chamber means and defining a through-bore free of any straight through-passage extending longitudinally rectilinearly through said through-bore to prevent ejection of a projectile straight therethrough while permitting effectively free tear gas discharge therethrough.

6. The starter gun of claim 5 wherein said through-bore includes blocking means for partially transversely blocking said through-bore at a plurality of longitudinally spaced positions, said blocking means comprising a plurality of blocking portions each blocking slightly more than one-half the cross section of the barrel through-bore.

7. The starter gun of claim 5 wherein said through-bore is cylindrical and is provided with blocking means comprising a plurality of segmentally cylindrical blocking portions.

8. The starter gun of claim 5 wherein said through-bore is cylindrical and is provided with blocking means comprising a plurality of segmentally cylindrical blocking portions each having a planar chordal surface adjacent the axis of the through-bore.

9. The starter gun of claim 5 wherein said through-bore includes blocking means comprising a plurality of blocking portions each blocking slightly more than one-half the cross section of the barrel through-bore, said blocking portions being spaced longitudinally of the through-bore to define a transverse passage portion therebetween.

10. The starter gun of claim 5 further including means for dividing said front portion into a plurality of through-passages.

11. A starter gun for selectively firing blank cartridges and tear gas cartridges, comprising: a cylinder having a rear portion defining a plurality of firing chambers each adapted to receive selectively alternatively a blank cartridge and a tear gas cartridge, and a front portion defining a transfer-passage for conducting tear gas forwardly from said firing chambers; a barrel extending forwardly from said cylinder front portion and defining a through-bore; means for firing cartridges in said firing chambers seriatim aligned with said barrel; and a plurality of flat radial dividing walls dividing said transfer-passage of the cylinder front portion into a plurality of through-passage sectors aligned one each with said firing chambers for providing a concentrated emission of tear gas from a fired tear gas cartridge in the associated one of said firing chambers into said barrel through-bore.

12. A starter gun for selectively firing blank cartridges and tear gas cartridges, comprising: a cylinder having a rear portion defining a plurality of firing chambers each adapted to receive selectively alternatively a blank cartridge and a tear gas cartridge, and a front portion defining a transfer-passage for conducting tear gas forwardly from said firing chambers; a barrel extending forwardly from said cylinder front portion and defining a through-bore; means for firing cartridges in said firing chambers seriatim aligned with said barrel; and means dividing said transfer-passage of the cylinder front portion into a plurality of through-passages aligned one each with said firing chambers for providing a concentrated emission of tear gas from a fired tear gas cartridge in the associated one of said firing chambers into said barrel through-bore, said transfer passage being right-circularly cylindrical and said dividing means dividing said transfer-passage into a plurality of pie-shaped through-passages.

13. The starter gun of claim 11 wherein said dividing means substantially fully separates said through-passages.

14. The starter gun of claim 11 wherein said cylinder defines a constricted passage between each firing chamber and its associated through-passage.

* * * * *